US005609098A

United States Patent [19]

Abe et al.

[11] Patent Number: 5,609,098

[45] Date of Patent: Mar. 11, 1997

[54] PAPER CALENDERING APPARATUS

[75] Inventors: Tsuyoshi Abe; Akira Nomoto, both of Tokyo, Japan

[73] Assignee: Nippon Paper Industries Co., Ltd., Tokyo, Japan

[21] Appl. No.: 405,233

[22] Filed: Mar. 16, 1995

[30] Foreign Application Priority Data

Mar. 17, 1994 [JP] Japan ..... 6-046277

[51] Int. Cl.[6] ..... D21G 1/00

[52] U.S. Cl. ..... 100/331; 100/168; 100/172; 100/333; 100/334

[58] Field of Search ..... 100/47, 93 RP, 100/161, 162 B, 168–172

[56] References Cited

U.S. PATENT DOCUMENTS

| | | | |
|---|---|---|---|
| 187,586 | 2/1877 | Bird | 100/172 |
| 2,732,591 | 1/1956 | Whittum | 100/162 B |
| 3,670,644 | 6/1972 | Hoever et al. | 100/47 |
| 4,117,054 | 9/1978 | Salo | 100/47 |
| 4,406,139 | 9/1983 | Schiffers | 100/162 B |
| 4,480,537 | 11/1984 | Agronin et al. | 100/47 |
| 4,658,621 | 4/1987 | Link et al. | 100/162 B |
| 4,757,582 | 7/1988 | Verkasalo | 100/47 |
| 4,793,250 | 12/1988 | Niskanen | 100/162 B |
| 5,057,167 | 10/1991 | Gersbeck | 100/47 |
| 5,295,803 | 3/1994 | Ogawa et al. | 100/93 RP |

FOREIGN PATENT DOCUMENTS

| | | | |
|---|---|---|---|
| 921563 | 10/1994 | Finland . | |
| 4-185790 | 7/1992 | Japan | 100/161 |

*Primary Examiner*—Stephen F. Gerrity
*Attorney, Agent, or Firm*—Burns, Doane, Swecker & Mathis, L.L.P.

[57] ABSTRACT

A paper calendering apparatus comprises a nip section for advancing paper sheets formed by at least a pair of rollers, one of which is a metal roller and the other of which is a resilient roller or a metal roller, wherein a gap of equal spacing is formed along the entire width of the roller face at the nip section of the pair of rollers, and is set to less than the thickness of the paper sheet to be finished.

4 Claims, 5 Drawing Sheets

PAPER CALENDERING APPARATUS

BACKGROUND OF THE INVENTION

1. Field of the Invention

The present invention relates to a paper calendering apparatus. Specifically, it relates to a paper calendering apparatus used to improve the surface quality, such as smoothness and gloss, of paper sheets.

2. Description of the Related Art

There exist a variety of types of calendering apparatuses used in the making of paper, typical examples of which are hard nip calenders and supercalenders.

Chilled nip calenders are apparatuses which may be adapted for online finishing as an addition to a paper machine after the drier, whereby the surface quality of paper sheets is modified as they pass through a pair of roller nips, while the surfaces of the metal rollers are chilled.

Supercalenders, on the other hand, comprise a series of alternating resilient rollers and chilled rollers in a vertical direction, and unlike hard nip calenders, the paper sheet rollers are subjected to the high-pressure multinip finishing while offline, due to restrictions on the finishing speed placed in consideration of the life of the resilient rollers, and therefore this type of calender is suited for the production of highly smooth, high gloss paper sheets such as gravure printing sheets.

In addition to the apparatuses described above, recent years have also seen the development of high-temperature soft nip calenders used online in the same manner as hard nip calenders, which aim at extending the life of the resilient rollers by using a resilient roller and a chilled roller as one pair and limiting the number of nips around the resilient roller to one, and high-temperature soft nip calenders which perform high-temperature finishing of paper sheets and guarantee a level of near-supercalender quality in an online manner by heating of the chilled rollers.

In hard nip calenders made of metal rollers, and supercalenders and soft nip calenders which employ resilient rollers, there are clear differences in the basic functions for modifying the surface quality of paper. Freshly dried paper by a paper machine is of uneven thickness, but the following may be said regarding the changes which occur in the surface condition of a paper sheet when passed through the nips of the calender apparatuses described above for finishing, based on a cross section taken through the path of the paper.

First, in the case of a hard nip calender which forms nips with chilled metal rollers, the raised sections of the paper sheet surface are pressed down and made flat, but the depressed sections receive no pressure even when the chilled rollers contact the surface, and this tends to create an uneven gloss, while the density cannot be made uniform despite the uniform thickness of the paper sheet, thus resulting in uneven density.

Next, in the case of a soft nip calender which forms a nip with a resilient roller and a chilled roller, when a paper sheet with non-uniform thickness immediately after drying in a paper machine passes through the calender, the surface of the paper sheet contacting the chilled roller surface is made flat by the smooth surface of the roller. However, during the flat finishing of the chilled roller side, on the rear side of the paper sheet which is the paper sheet surface on the resilient roller side, there appears a more complex unevenness due to the added unevenness from the chilled roller side in addition to its original unevenness. Nevertheless, since the resilient rollers, being resilient, are capable of being deformed by the shape corresponding to the unevenness, the unevenness of the paper surface can also undergo pressure finishing. Also, the density of the paper sheet becomes uniform despite the non-uniformity of the thickness, and the smoothness of the roller surface is transferred to the paper sheet surface on the chilled roller side, thus imparting smoothness and gloss thereto.

When soft nip calendered products and hard nip calendered products are compared in terms of printing suitability and printing surface feel, it is found that the uniform-density soft nip calendered products have uniform absorption and adhesion of ink, while in terms of the bulk, i.e., the specific volume, they also have larger thicknesses than hard nip products as a result of the use of the resilient rollers.

Furthermore, supercalenders perform multinip finishing with a series of alternating resilient rollers (fiber coils) consisting chiefly of cotton, paper and other natural fibers and chilled rollers in a vertical direction, and they are suitable for the production of highly smooth paper such as that required for gravure printing.

However, since in supercalenders the nips are formed with the top and bottom of the fiber rollers in contact with the metal rollers, double linear pressure is undergone with each turn of the fiber rollers, and therefore the fiber rollers, having a relatively low hardness of 75–85 in terms of Shore durometer hardness, are able to ensure a more uniform density of the paper sheet; however, this is not without a considerable degree of elastic deformation at the locations receiving the linear pressure, and thus because of repeated linear pressure within a short period of time, troubles tend to occur including damage by internal heat due to hysteresis, making it impossible to recover the original form.

For this reason, supercalenders are slower than the speed of paper machines of reducing the paper stock and therefore they are provided offline; still, the same problems remain of roller replacement and management as a result of roller damage.

Resilient rollers used in soft nip calenders are constructed with a heat-resistant synthetic resin layer over the full width and circumference of a metal roller surface, and the thickness of the synthetic resin layer is about 10 mm for the purpose of heat release, while the hardness of the resin roller is 85–95 in terms of Shore durometer hardness, which is somewhat higher than the hardness of natural fiber resilient rollers used in supercalenders, and therefore there is less resilient deformity at the nip sections; furthermore, since the resin roller is limited to forming a nip with a metal roller at only one location on its circumference, time is ensured for restoration of the original form after resilient deformity at the nip, the life of the resin layer of the resilient roller is extended, and the calender may be operated online.

However, although soft nip calendered products have better surface quality, including gloss and smoothness, than hard nip calendered products, the nip finishing frequency is lower, and furthermore since the hardness of the resin roller is higher than natural fiber rollers, the surface quality of the paper sheets does not begin to approach that of supercalendered products.

Recently, in order to attain supercalender quality with the above-mentioned soft nip calenders, high-temperature soft nip calendering has been developed wherein the finishing is performed with the metal rollers heated to a high temperature of about 175° C. at which the fibers of the paper sheet begin to deform; this, however, tends to further shorten the life of the resin rollers.

Despite advances in the development of heat-resistant resins their present limit is around 110°–150° C., and therefore currently paper sheets and resin roller surfaces must be monitored while the resin roller surfaces are cooled with cold air, and at temperatures of the cut paper and resin roller surface above the acceptable range the operation must be carried out with an apparatus which allows prompt release of the nips, with the greatest care to damage prevention and general upkeep of the resin rollers.

SUMMARY OF THE INVENTION

It is an object of the present invention to resolve the problems of the prior art as explained above, by providing a paper calendering apparatus capable of producing paper sheets with the same quality and bulking power as obtained by conventional calendering, and prolonging the life of resilient rollers even with high-temperature finishing.

According to the present invention, the above-mentioned object is achieved by providing a paper calendering apparatus comprising a nip section for advancing paper sheets formed by at least a pair of rollers, one of which is a metal roller and the other of which is a resilient roller or a metal roller, wherein a gap of equal spacing is formed along the entire width of the roller face at the nip section of the pair of rollers, and is set to less than the thickness of the paper sheets to be finished.

DESCRIPTION OF THE PREFERRED EMBODIMENTS

Figure 1:
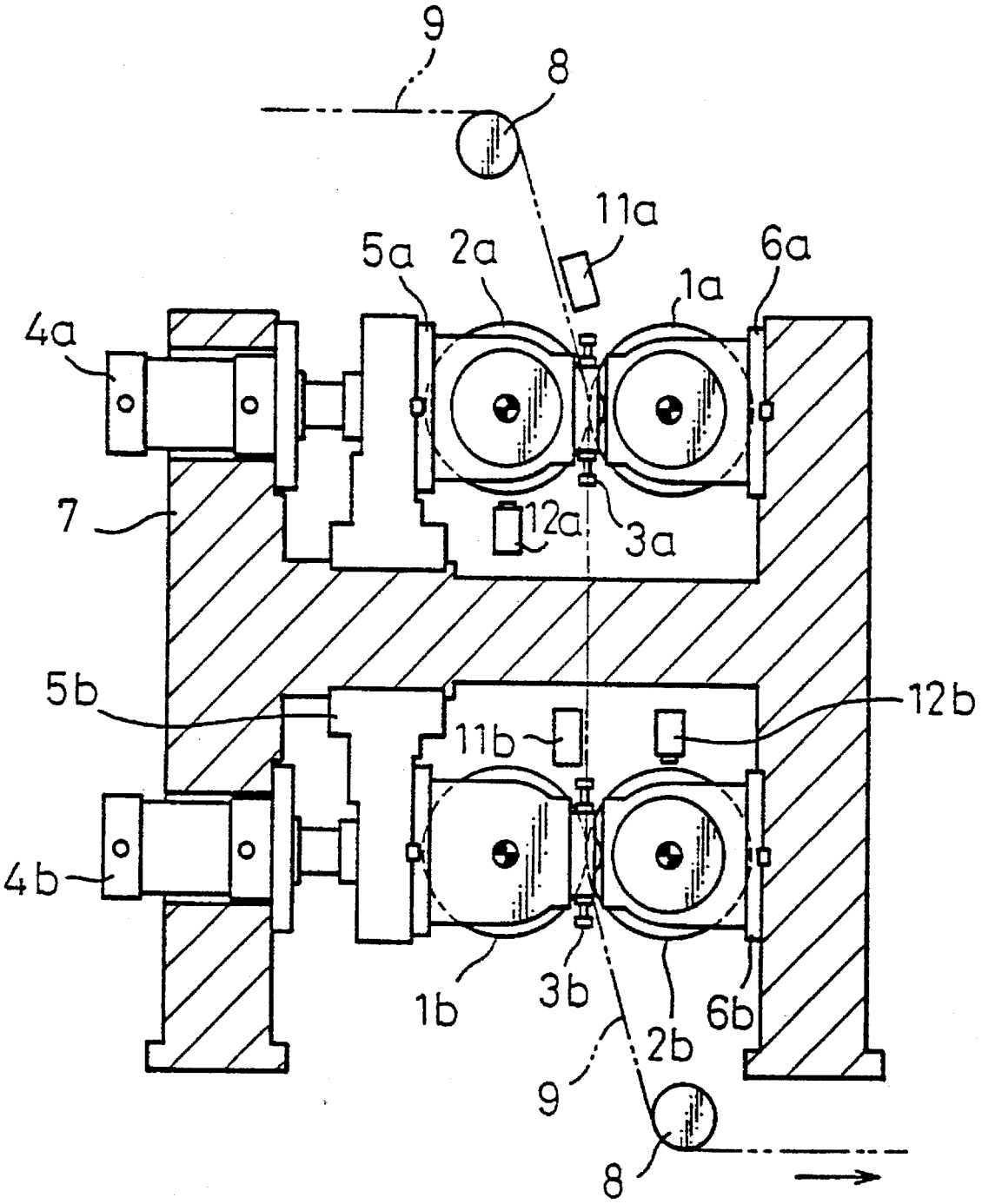
FIG. 1 is a schematic diagram of a calendering apparatus according to an embodiment of the present invention.

The paper calendering apparatus according to the present invention is a calender in which a nip section for advancing paper sheets is formed by at least a pair of rollers, one of which is a metal roller and the other of which is a resilient roller or a metal roller, with a gap of equal spacing formed along the entire width of the roller face at the nip section of the rollers where paper is to pass through, which gap is less than the thickness of the paper sheets to be finished, and surface finishing of paper sheets is performed by advancing the paper sheets through the gap. Here, the gap is preferably set to 20% to 80% of the thickness of the paper sheets to be finished. Also, one of the metal rollers is preferably rotated at a higher circumferential speed, particularly 20% to 200% higher or more, than the other roller which rotates at a speed which matches the speed of the paper sheet, while the surface temperature of one of the metal rollers of the calender apparatus is preferably heated to 50°–300° C.

The metal rollers used in the present invention may be chilled rollers the surfaces of which have been hardened by rapid cooling during centrifugal casting; plated rollers whose surfaces have been subjected to metal plating such as chrome plating; or ceramic rollers whose surfaces have been spray coated with zirconia, silicon nitride, silicon carbide, alumina, sialon, cermet, titanium boride, or the like. The surface roughness is preferably in the range of an Rmax of 0.1 to 1.0 μm as measured according to JISB-0601.

According to the present invention, when employing a combination of a chilled roller with a surface roughness Rmax in the range of 0.5 to 1.0 μm and a metal-plated roller with a surface roughness Rmax in the range of 0.1 to 0.7 μm, the paper sheet surface of the side to which has been transferred the surface of the smooth metal-plated roller with the low surface roughness results in having superior gloss and smoothness in comparison with the paper sheet surface on the chilled roller side. Ceramic rollers are abrasion-resistant and therefore allow reduction in the roller-grinding frequency.

The resilient roller is a natural fiber roller with a Shore durometer hardness of 75–85 and consisting mainly of natural fiber such as cotton, paper, etc., or a resin roller with a Shore durometer hardness of 85–95 prepared by covering the circumference of the roller to a thickness of about 10 mm with a heat-resistant synthetic resin layer which comprises one or more selected from epoxy resins, polyamide resins, polyimide resins, polyimidadmide resins, urethane resins and the like.

According to the present invention, in the case where one of the rollers forming the nip is a metal roller and the other roller is a resilient roller, at the nip of the rollers through which paper sheets pass there is formed a gap of equal spacing along the entire width of both roller faces. The gap at the nip section is preferably 20% to 80%, and more preferably 40% to 60%, of the thickness of the paper sheet to be finished, for a still more satisfactory effect. When this gap is maintained during pressurization for surface finishing of paper sheets there is markedly less deformation at the nip section of the resilient roller in comparison to conventional soft nip calenders, the occurrence of internal heat damage by hysteresis is drastically reduced, and the life of the resilient resin roller covering material, which has been a weakness of conventional resilient rollers, may be extended by about 5 times in comparison to soft nip calenders; in addition, it is possible to produce so-called "stiff" paper sheets whose thickness, or bulk, after finishing has a gauge of about 10% compared to those produced by soft nip calenders.

Furthermore, in the case where both rollers forming the nip are metal rollers, at the nip between the rollers through which the paper sheets pass there is formed a gap of equal spacing along the entire width of both roller faces. The gap at the nip section is preferably 20% to 80%, and more preferably 40% to 60%, of the thickness of the paper sheets to be finished, for a still more satisfactory effect. When a paper sheet is fed through the gap for pressure finishing, there cannot be expected the same surface quality as if a resilient roller were positioned as the opposite roller, but it is still possible to produce a paper sheet with about a 5% gauge, compared with a conventional hard nip.

Furthermore, according to the present invention the metal roller and the resilient roller are rotated separately using different driving apparatuses, and by rotating one of the metal rollers forming the nip at a circumferential speed faster than that of the other resilient roller or metal roller which rotates at a speed matching that of the paper sheet, to increase the finishing time at the nip, it is possible to obtain the same surface quality as with conventional soft nip and chilled nip calenders. In such a case, the effect of improved surface quality of the paper sheet is greater the longer the finishing time at the nip, but from the point of view of stable product quality, the roller with the higher circumferential speed preferably has speed increase of about 20–100%.

Variation in the nip gap and speed difference between the rollers and the roller surface temperature will allow the production of paper sheets with a wide variety of quality designs without loss of bulk. In particular, the surface temperature of the metal roller may be raised to within a wide range of 50°–300° C. by heating. When the metal roller is used at a high temperature, provision of means for auxiliary heating and wetting of the surface of the paper sheet before the entry at the nip section will allow increased efficiency of thermal finishing, while provision of means for cooling a portion or the entire width of the surface of the resilient roller using cold air is effective for extending the life of the resilient roller.

According to the present invention, as means for forming the gap at equal spacing along the entire width of the pair of roller faces, at least one of the rollers preferably is equipped at both ends of the bearing with a microscrew jack for adjustment of the nip spacing to a precision of 5 μm or lower. By setting the distance between the centers using the screw jack, it is possible to minimize resilience deformities at the resilient roller nip section under any pressure, and as a result reduce the heat release due to hysteresis at the nip section and contribute to an extended life of the resilient roller.

For precise measurement during adjustment and inspection of the prescribed nip gap, gap measuring light may be used at the nip section with projecting and receiving sections placed at the entry side and exit side of the nip. Fine adjustment of the roller nip gap may be made at the site of operation by adjusting the microjack screws depending on the thickness of the paper sheet and the degree of smoothness and gloss of the paper sheet surface.

For even further extended life of the resilient roller, the surface of the resilient roller is preferably cooled with cold air, and to promote plastic deformation of the surface layer of the paper sheet at the nip section, it is still more effective to wet and heat the surface of the paper sheet which is in contact with the metal roller, near the nip entry.

In cases where the pair of rollers in the apparatus of the present invention consists of a metal roller and a resilient roller, pressure by the metal roller on the front side of the paper sheet as it passes through the nip causes the unevenness on the front side of the paper sheet to become uniform as the roller surface is transferred thereon, while the unevenness on the back side is increased; nevertheless, all of the unevenness is absorbed by the resiliency of the resilient roller. Consequently, the metal roller surface is able to impart consistent smoothness and gloss. Adjustment of the post-calendering paper sheet thickness is accomplished either by use of a crown adjustment roller which allows adjustment of the outer diameter of the metal roller by oil pressure provided inside the roller, or by changes in the outer shape by partial heating or cooling of the surface of the metal roller.

Figure 4:
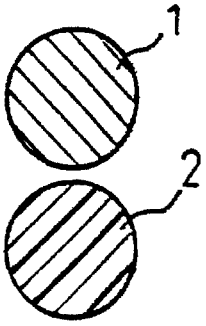
FIG. 4 is an illustrative side section view showing a nip section formed by a metal roller and a resilient roller.
Figure 5:
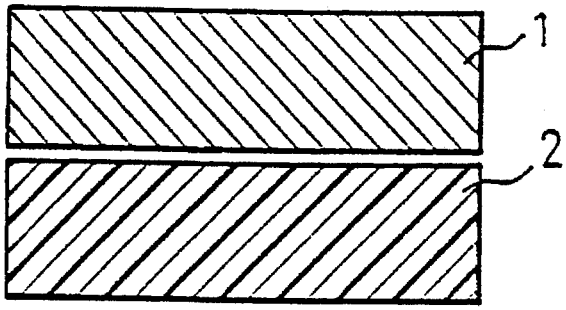
FIG. 5 is an illustrative longitudinal section view of the pair of rollers in FIG. 4.
Figure 6:
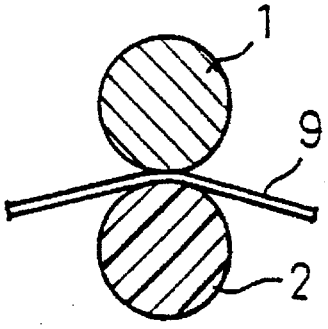
FIG. 6 is an illustrative side section view of paper passing through the pair of rollers in FIG. 4.
Figure 7:
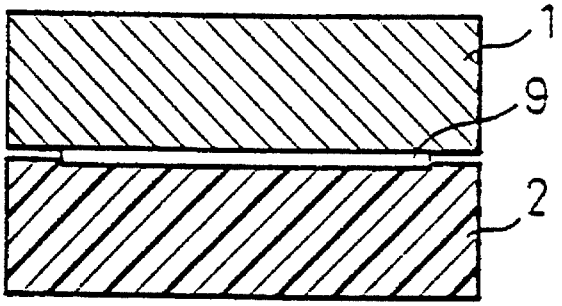
FIG. 7 is an illustrative longitudinal section view of the pair of rollers in FIG. 6.
Figure 8:
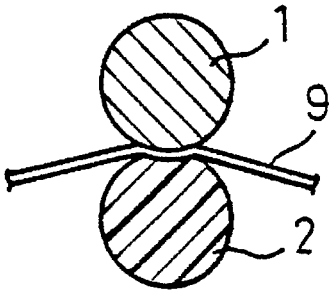
Fig. 8 PRIOR ART
FIG. 8 is an illustrative side section view of paper passing through the nip section of a conventional soft nip calender.
Figure 9:
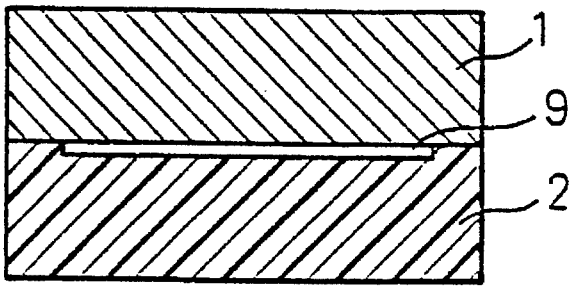
Fig. 9 PRIOR ART
FIG. 9 is an illustrative longitudinal section view of the pair of rollers in FIG. 8.

FIG. 4 is a side section view showing a nip section formed by a metal roller 1 and a resilient roller 2, FIG. 5 is a longitudinal section view of FIG. 4, FIG. 6 is a side section view of paper passing through FIG. 4, FIG. 7 is a longitudinal section view of FIG. 6, FIG. 8 is a side section view of paper passing through the nip section of a conventional soft nip calender, and FIG. 9 is a longitudinal section view of FIG. 8, all of which drawings are shown illustratively. As shown in FIGS. 4 and 5, both rollers are arranged so that a gap is formed between them to allow them to withstand pressure. As shown in FIGS. 6 and 7, the surface layer of the paper sheet 9 in contact with the metal roller 1 or resilient roller 1 and 2 is finished, but because of the gap the center of thickness of the paper sheet is not easily deformed. This creates a sheet with bulk, or thickness. Also, as shown in FIGS. 8 and 9, since resilient rollers become deformed at the nip section in conventional soft nip calenders, the surfaces of the resilient roller and metal roller approach or contact with each other at the ears where no paper is present, leading to transmission of the temperature of the metal roller to the elastic roller. For example, when a paper sheet is passed through at 64 g/m$^2$ with a metal roller temperature of 180° C. in a soft nip calender, the surface temperature at the ears of the resilient roller reaches about 90° C.

However, as shown in FIG. 7, according to the present invention a gap is formed between the rollers at the ears where no paper is present, and therefore, when the gap between the rollers was set to 40 μm, the heat conduction from the metal roller 1 at 180° C. to the resilient roller 2 resulted in a temperature of 41° C. at the center of the resilient roller and 49° C. at the ends of the resilient roller. This illustrates that the gap effectively prevents heat conduction not only at the sections where the paper sheet is not held in the gap between the rollers, but also at the section where it is held, to thus reduce temperature increase at the surface of the resilient roller.

On the other hand, in the case where the nip is formed by two metal rollers the surface finishing is the same as with a conventional chilled nip; however, since according to the present invention a gap is maintained at the nip in this case as well, only the surface layers of the paper deform with virtually no deformity at the center section, when viewed by a cross-section in the direction of paper flow as the paper sheet passes through the nip. Consequently, the finished paper sheet has greater gauge, or bulk, compared to chilled nip products.

Furthermore, by increasing the circumferential speed of one of the metal rollers forming the nip, it is possible to prolong the finishing time at the nip, accelerate the compositional deformity of the paper sheet, and improve the surface quality of the paper sheet. The circumferential speed of one of the metal rollers forming the nip is preferably a faster circumferential speed of 1.2 times or higher, and more preferably about 1.5 times, with respect to the speed of the other resilient roller or metal roller which matches the speed of the paper sheet.

Embodiments of the present invention are explained below with reference to the drawings.

FIG. 1 shows an embodiment of a calendering apparatus according to the present invention, on the calender frame 7 of which there are mounted a bearing housing **6*a* which supports both ends of a metal roller 1*a*, and a bearing housing 5*a* which supports both ends of a resilient roller 2*a*. The bearing housing 5*a* is mounted on the frame 7 in a horizontally movable manner. That is, the resilient roller 2*a* is capable of applying a given pressure against a paper sheet 9 at the nip section through which the paper sheet 9 passes, upon movement of both ends of the bearing housing 5*a* by a pressure cylinder 4*a* also mounted on the frame 7**.

Also, a microscrew jack 3 is mounted on the bearing housing **5*a*, to maintain a gap for avoiding contact of the metal roller 1*a* and the resilient roller 2*a* at the nip section even upon operation of the above-mentioned pressure cylinder 4*a*. That is, the microscrew jack 3*a* is adjusted to maintain a gap of 20 to 80% relatively to the thickness of the paper sheet 9. In practice, 40 to 60% of the thickness of the paper sheet 9** is effective. During adjustment of the gap, light is used for precise measurement by projecting and receiving sections placed at the entry side and exit side of the nip.

In addition, the metal roller 1*a* and resilient roller 2*a* are each furnished with separate rotation drivers which are not shown, and the metal roller 1*a* is rotated at a speed of 1.2 times or higher, and preferably at a speed of 1.2 to 1.5 times, with respect to the speed of the paper sheet 9 and the resilient roller 2*a* which move at the same speed. A humidifier and heater, 11*a* and 11*b*, are provided to wet and heat the surface of the paper sheet 9 in order to promote plastic deformation of the surface layer at the nip sections of the paper sheet. Cold air blower nozzles 12*a*, 12*b* are provided for air cooling of the resilient roller surfaces, in order to ensure a more extended life for the resilient rollers.

The metal rollers 1*a* and 1*b* are constructed with heating means by steam, hot water, oil, electric induction or the like (not shown) for high-temperature finishing. In cases where paper flow trouble occurs due to drawing fluctuations as a result of the difference in circumferential speeds when the speed of the metal rollers 1*a* and 1*b* are increased over that of the resilient rollers 2*a* and 2*b*, the problem may be resolved either by slightly increasing the size of the nip gap or by increasing the length of contact of the paper sheet 9 with the resilient rollers 2*a* and 2*b*.

Figure 2:
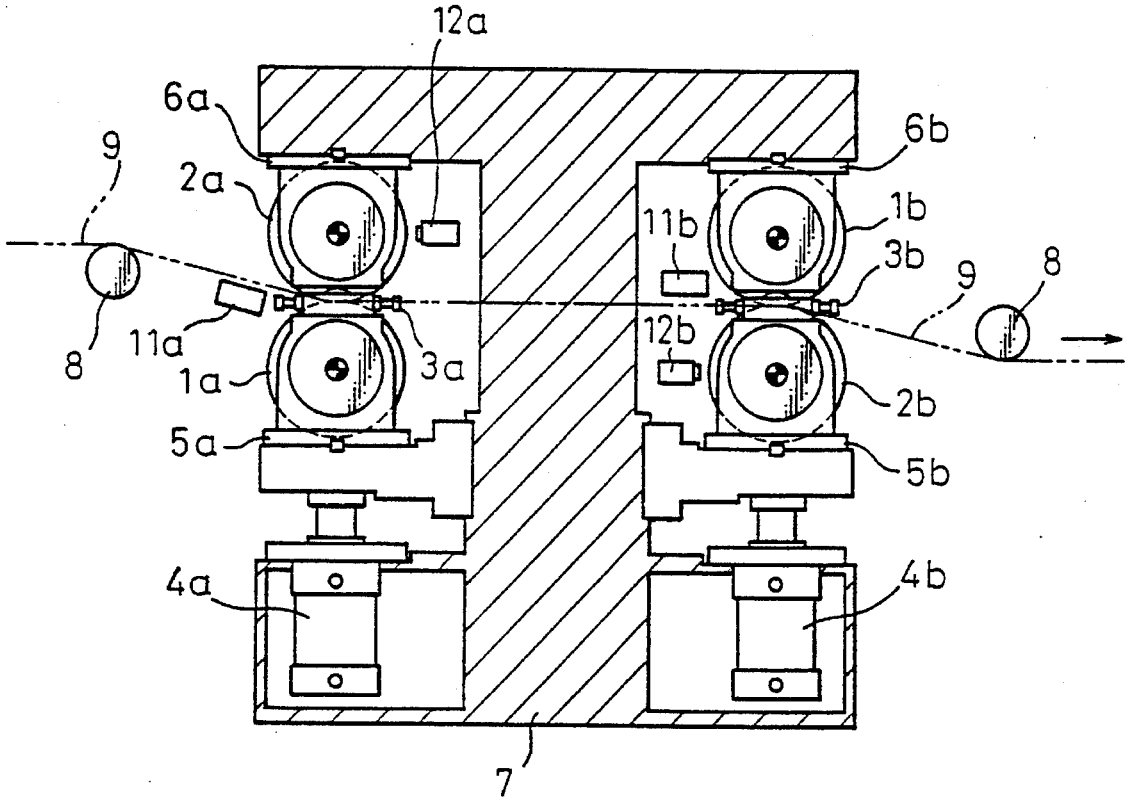
FIG. 2 is a schematic diagram of a calendering apparatus according to another embodiment of the present invention.

FIG. 2 shows a construction wherein the paper sheet 9 in FIG. 1 is fed through horizontally, and it is otherwise identical to FIG. 1. Since there is considerably more bending in this construction than in the construction of FIG. 1 by the pressure and weight of the rollers, crown adjustment of either or both of the rollers forming the nips becomes even more essential.

Figure 3:
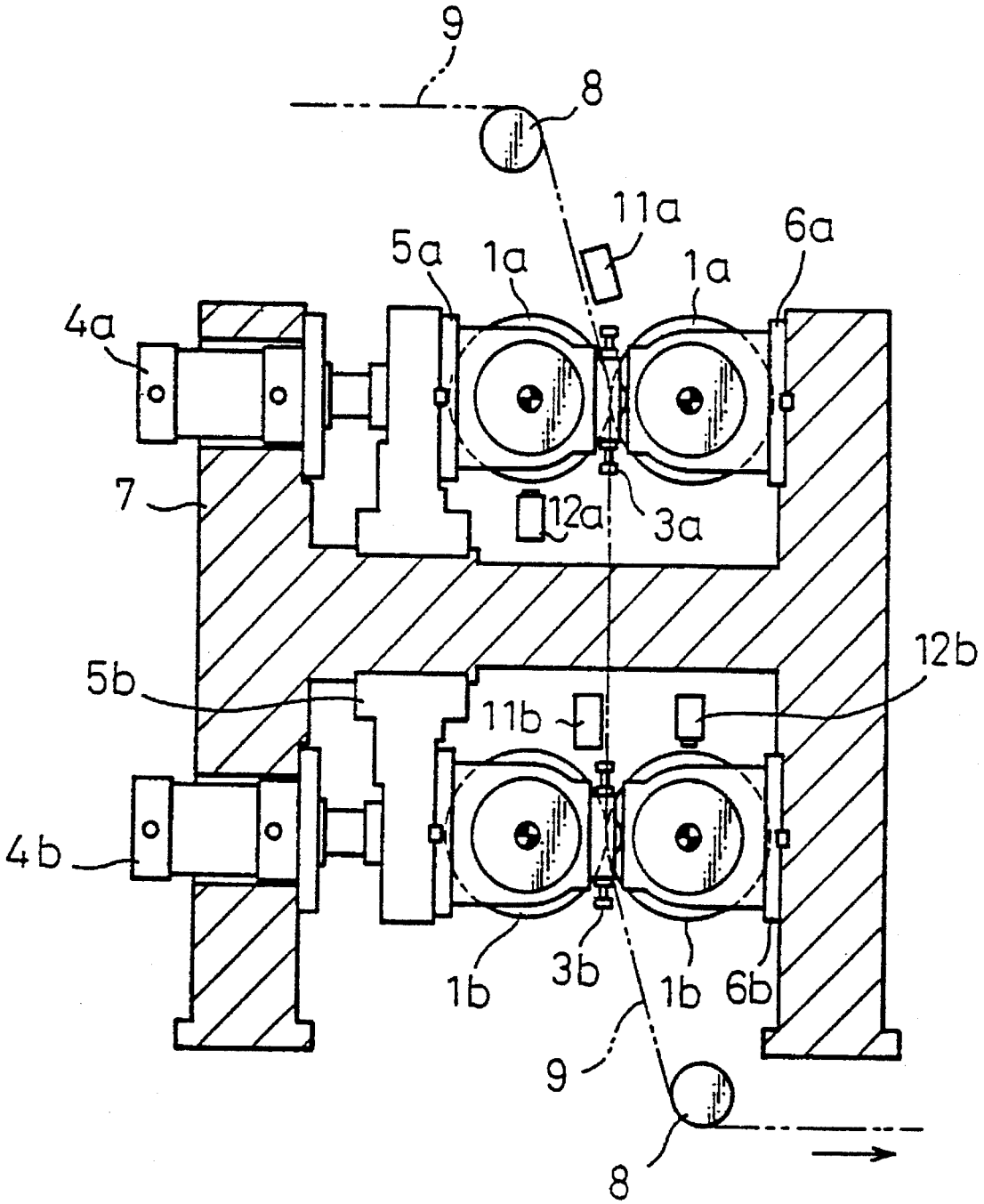
FIG. 3 is a schematic diagram of a calendering apparatus according to yet another embodiment of the present invention.

FIG. 3 is a case in which the resilient rollers 2*a*, 2*b* of FIG. 1 have been replaced with metal rollers 1*a*, 1*b*.

Figure 10:
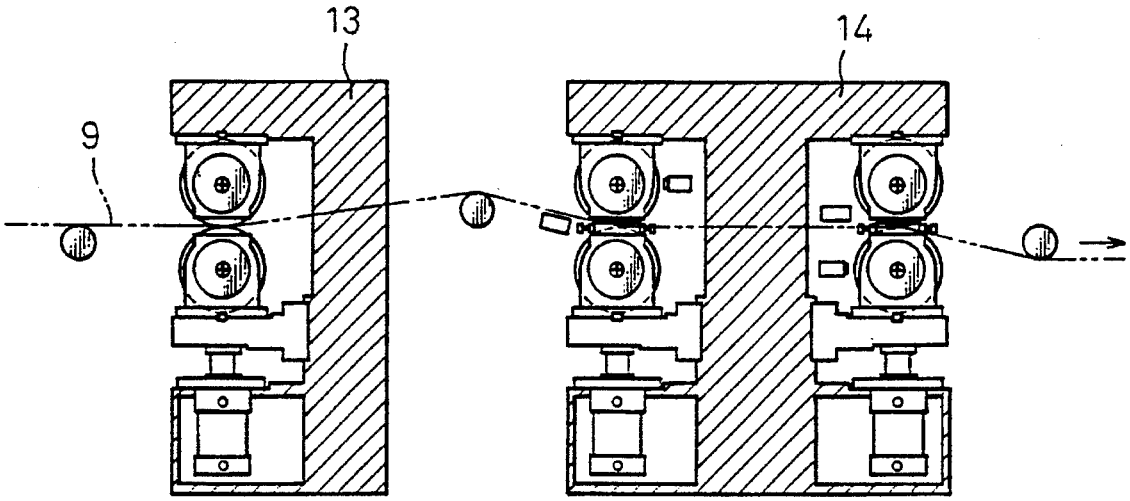
FIG. 10 is a schematic diagram of an example of an arrangement of a calendering apparatus according to the present invention.

FIG. 10 is a schematic diagram showing an example of an arrangement of a calendering apparatus according to the present invention. In this arrangement, a conventional machine calendering apparatus 13 is arranged alongside the calendering apparatus 14 for preprocessing. The paper sheet 9 is first subjected to a certain degree of surface finishing by linear pressure exerted by the machine calendering apparatus 13, but this is also accompanied by reduction in the paper thickness, or loss of bulk. Next, the paper sheet 9 is again surface-finished at the calendering apparatus 14 of the present invention to reach the desired quality standard. The gap in this calendering apparatus 14 is set with prior consideration given to the loss in thickness of the paper sheet 9 due to preprocessing at the machine calendering apparatus 13, but since the unevenness of the surface of the paper sheet 9 undergoes considerable improvement along with the reduction in the paper thickness, so that the difference between the raised and depressed sections is diminished, the gap between the rollers of the calendering apparatus 14 may be set to the maximum for the utmost suppression of reduction in the thickness of the paper sheet 9 and to finish the paper to a satisfactory surface condition. Thus, a conventional calendering apparatus may be used for preprocessing in conjunction with the calendering apparatus of the present invention. In a conventional calendering apparatus, where a low linear pressure is employed, a bulky paper sheet can be produced.

The paper sheet finishing capabilities of the apparatus according to the embodiment of the present invention shown in FIG. 1 and of a conventional high-temperature soft nip calender will now be compared.

The paper sheet used for the test was lightly coated paper with a basis weight of 64 g/m$^2$ and a thickness of about 79 μm. In the calendering apparatus, the resilient roller had a Shore durometer hardness of 91, an outer diameter of 510 mm and a cover material thickness of 10 mm, while the chilled roller had an outer diameter of 510 mm and a surface temperature of 180° C., the linear pressure at the nip was 300 kg/cm, and the speed of the resilient roller and the chilled roller were set equal at 800 m/min; however, in the apparatus of the present invention, in addition the gap at the nip was set to 40 μm and the circumferential speed of the metal roller was increased to 50% over that of the resilient roller.

When the properties of the finished paper sheets were examined, they were found to have equal surface qualities of smoothness and gloss, but in terms of the bulk, or gauge, of the paper sheets, the product finished with the apparatus of the present invention had about a 10% gauge.

Furthermore, in comparing the apparatuses themselves, resin cover materials of resilient rollers of high-temperature soft nip calenders have heat fastness temperatures on the order of 110° to 150° C. Considering that the temperature at which paper sheet fibers being to deform is around 175° C., the heat fastness temperature of resin cover materials is clearly too low and will tend to result in problems of durability; however, with the present invention this problem is overcome by the gap at the nip section.

According to the present invention, it is possible to produce paper sheets with thickness, or bulk, and having the same quality as by conventional calendering, while ensuring a long life of the resilient rollers even with high-temperature finishing; consequently, not only does it become possible to obtain paper sheets of conventional supercalender quality in an online manner, but paper sheets with a wide variety of qualities may be produced.

What is claimed is:

1. A paper calendering apparatus comprising a nip section for advancing a paper web, the nip section being formed by at least a pair of rollers, one of which is a metal roller and the other of which is one of a resilient roller and a metal roller, a first one of the rollers of said pair of rollers rotating at the same speed as the running speed of the paper web to be finished, and the other roller rotating at a faster circumferential speed than the first roller, the first roller which rotates at a faster circumferential speed than the other roller being a metal roller, the metal roller rotating at a circumferential speed which is 20% to 200% greater than that of the other roller, wherein a gap of equal spacing is formed along the entire width of the roller face at the nip section of said pair of rollers, and is set to less than the thickness of the paper web to be finished.

2. The paper calendering apparatus as set forth in claim 1, wherein the gap at said nip section is set at 20% to 80% of the thickness of the paper web to be finished.

3. The paper calendering apparatus as set forth in claim 2, wherein said metal roller is heated to a surface temperature of 50° to 300° C.

4. The paper calendering apparatus as set forth in claim 1, wherein said metal roller is heated to a surface temperature of 50° to 300° C.

* * * * *